US008723763B2

(12) United States Patent
Jeong

(10) Patent No.: US 8,723,763 B2
(45) Date of Patent: May 13, 2014

(54) THRESHOLD VOLTAGE CORRECTION FOR ORGANIC LIGHT EMITTING DISPLAY DEVICE AND DRIVING METHOD THEREOF

(75) Inventor: Jin-Tae Jeong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1027 days.

(21) Appl. No.: 12/785,296

(22) Filed: May 21, 2010

(65) Prior Publication Data

US 2011/0050741 A1 Mar. 3, 2011

(30) Foreign Application Priority Data

Sep. 2, 2009 (KR) ..... 10-2009-0082451

(51) Int. Cl.
*G09G 3/32* (2006.01)

(52) U.S. Cl.
USPC ..... 345/82

(58) Field of Classification Search
USPC ..... 345/82, 690, 76
See application file for complete search history.

(56) References Cited

U.S. PATENT DOCUMENTS

| | | | | |
|---|---|---|---|---|
| 7,358,941 | B2 | 4/2008 | Ono et al. | |
| 2006/0071884 | A1* | 4/2006 | Kim | 345/76 |
| 2007/0040772 | A1* | 2/2007 | Kim | 345/76 |
| 2008/0074362 | A1* | 3/2008 | Ogura | 345/77 |
| 2009/0167648 | A1* | 7/2009 | Jeon et al. | 345/76 |
| 2009/0189924 | A1* | 7/2009 | Ogura | 345/690 |
| 2009/0251455 | A1* | 10/2009 | Park et al. | 345/214 |
| 2010/0045646 | A1 | 2/2010 | Kishi | |

FOREIGN PATENT DOCUMENTS

| | | | |
|---|---|---|---|
| CN | 1917015 | A | 2/2007 |
| EP | 1 755 104 | A2 | 2/2007 |
| EP | 2 093 748 | A1 | 8/2009 |
| JP | 2005-128521 | | 5/2005 |
| JP | 2005-352411 | | 12/2005 |
| JP | 2007-052422 | | 3/2007 |
| JP | 2008-176272 | | 7/2008 |
| KR | 1020030075946 | A | 9/2003 |
| KR | 10-2006-0027023 | A | 3/2006 |
| KR | 10-2007-0049905 | | 5/2007 |
| KR | 10-2009-0011700 | A | 2/2009 |
| WO | WO 2008/108024 | A1 | 9/2008 |

OTHER PUBLICATIONS

European Search Report dated Nov. 5, 2010 for European Application 10169619.3, 9 pages.

(Continued)

*Primary Examiner* — Chanh Nguyen
*Assistant Examiner* — Jonathan Blancha
(74) *Attorney, Agent, or Firm* — Christie, Parker & Hale, LLP

(57) ABSTRACT

An organic light emitting display device includes: a scan driver for driving one or more scan lines and emission control lines; a data driver for sequentially providing j data signals to each of a plurality of output lines in each horizontal period; a demultiplexer for transmitting the j data signals to j first data lines, the demultiplexer being coupled to the output lines; a plurality of pixels at crossing regions of the scan lines and second data lines extending in a direction crossing the scan lines; and a common circuit unit for controlling voltages of the second data lines coupled to the pixels by using a reference voltage and an initial voltage and the data signals, the common circuit unit being coupled between the first data lines and the second data lines.

20 Claims, 11 Drawing Sheets

(56) References Cited

OTHER PUBLICATIONS

KIPO Office action dated Mar. 9, 2011, for Korean priority Patent application 10-2009-0082451.
Japanese Office action issued on Feb. 28, 2012 in corresponding Japanese Patent Application No. 2009-249367, 3pp.
SIPO Office action dated Jun. 18, 2012, for corresponding Chinese Patent Application No. 201010224792.2, (9 pages).
KIPO Office action dated Oct. 28, 2011 in the priority application 10-2009-0082451, 2 pages.
SIPO Patent Gazette dated Jan. 1, 2014, with English translation of cover page only, corresponding to Chinese Patent application 201010224792.2, (3 pages).

* cited by examiner

DATA DRIVER
120
TIMING CONTROLLER
150
SWITCH CONTROL UNIT
180
DCS,Data
CS3,CS4,CS5
CS1,CS2
SCS
SCAN DRIVER
110
DEMUX
170
O1
O2
Oi
D11
D12
D13
D14
D15
D16
D1m-2
D1m-1
D1m
D21
D22
D23
D24
D25
D26
D2n-2
D2n-1
D2m
160
130
140
Vint
Vref
ELVSS
ELVDD
S11
S21
E1
S12
S22
E2
S13
S23
E3
S1n
S2n
En

THRESHOLD VOLTAGE CORRECTION FOR ORGANIC LIGHT EMITTING DISPLAY DEVICE AND DRIVING METHOD THEREOF

CROSS-REFERENCE TO RELATED APPLICATIONS

This application claims priority to and the benefit of Korean Patent Application No. 10-2009-0082451, filed on Sep. 2, 2009, in the Korean Intellectual Property Office, the entire content of which is incorporated herein by reference.

BACKGROUND

1. Field

An aspect of an embodiment of the present invention relates to an organic light emitting display device and a driving method thereof.

2. Description of Related Art

Various flat panel display devices with reduced weight and volume in comparison to a cathode ray tube have been developed. Examples of the flat panel display devices include a liquid crystal display device, a field emission display device, a plasma display panel, an organic light emitting display device, etc.

Among the flat panel display devices, the organic light emitting display device displays an image by using organic light emitting diodes that emit light by recombining holes with electrons. The organic light emitting display device has low power consumption while having rapid response speed.

FIG. 1 is a circuit diagram showing a pixel of an organic light emitting display device according the related art.

Referring to FIG. 1, a pixel 4 includes a pixel circuit 2 for controlling an organic light emitting diode (OLED) connected to the pixel circuit 2, a data line Dm, and a scan line Sn.

An anode electrode of the OLED is connected to the pixel circuit 2, and a cathode electrode of the OLED is connected to a second power supply ELVSS. The OLED generates light having a luminance (e.g., a predetermined luminance) corresponding to the amount of current supplied from the pixel circuit 2.

The pixel circuit 2 controls the amount of current supplied to the OLED to correspond to a data signal provided from the data line Dm when a scan signal is provided to the scan line Sn. Here, the pixel circuit 2 includes a second transistor M2 connected to a first power supply ELVDD and the OLED, a first transistor M1 connected to the second transistor M2, the data line Dm, and the scan line Sn, and a storage capacitor Cst connected between a gate electrode and a first electrode of the second transistor M2.

A gate electrode the first transistor M1 is connected to the scan line Sn, and the first electrode of the first transistor M1 is connected to the data line Dm. In addition, a second electrode of the first transistor M1 is connected to one terminal of the storage capacitor Cst. Here, the first electrode is one of a source electrode or a drain electrode, and the second electrode is an electrode other than the first electrode. For example, when the first electrode is the source electrode, the second electrode is a drain electrode. The first transistor M1 connected to the scan line Sn and the data line Dm is turned on and provides the data signal provided from the data line Dm to the storage capacitor Cst when a scan signal is provided from the scan line Sn. Here, the storage capacitor Cst is charged with a voltage corresponding to the data signal.

The gate electrode of the second transistor M2 is connected to one terminal of the storage capacitor Cst, and the first electrode of the second transistor M2 is connected to the other terminal of the storage capacitor Cst and the first power supply ELVDD. In addition, a second electrode of the second transistor M2 is connected to the anode electrode of the OLED. The second transistor M2 controls the amount of current that flows to the second power supply ELVSS via the OLED from the first power supply ELVDD to correspond to a voltage value stored in the storage capacitor Cst. Here, the OLED generates light corresponding to the amount of current supplied from the second transistor M2.

The pixel 4 supplies a current corresponding to the voltage charged in the storage capacitor Cst to the OLED to display an image having a luminance (e.g., a predetermined luminance). However, the above described organic light emitting display device cannot display an image having uniform luminance due to a variation in threshold voltage of the second transistor M2.

In the related art, additional circuits such as a plurality of transistors are included in the pixel 4 for compensating for the variation of the threshold voltage of the second transistor M2. However, when the plurality of transistors (for example, 6 transistors) are included in the pixel 4 in order to compensate for the variation of the threshold voltage of the second transistor M2, reliability is deteriorated.

Further, in the related art, a voltage value of the first power supply ELVDD varies due to a voltage drop depending on the position of the pixel 2, and as a result, an image having desired luminance cannot be displayed.

SUMMARY

An aspect of an embodiment of the present invention provides an organic light emitting display device that may compensate for a threshold voltage of a driving transistor and a voltage drop of a first voltage supplied to the driving transistor.

According to an embodiment of the present invention, an organic light emitting display device is driven during a horizontal period comprising first, second, third, fourth, and fifth periods. The organic light emitting display device includes: a scan driver for driving one or more scan lines and emission control lines grouped by horizontal lines of the organic light emitting display device; a data driver for sequentially providing j data signals to each of a plurality of output lines of the data driver in every horizontal period; a demultiplexer for transmitting the j data signals to j first data lines, the demultiplexer being coupled to the output lines; a plurality of pixels at crossing regions of the scan lines and second data lines extending in a direction crossing the scan lines; and a plurality of common circuit units for controlling voltages of the second data lines coupled to the pixels by using a reference voltage, an initial voltage and the data signals, the common circuit units being coupled between the first data lines and the second data lines.

According to an embodiment of the present invention, there is provided a driving method of an organic light emitting display device that includes a pixel including a first capacitor coupled between a first data line for receiving a data signal and a second data line coupled to the pixel and a driving transistor for controlling an amount of current flowing to a second power supply from a first power supply through an organic light emitting diode. The method includes: supplying a reference voltage to the first data line and supplying an initial voltage to the second data line; electrically coupling the second data line to a gate electrode of the driving transistor while supplying the reference voltage to the first data line; increasing the voltage of the second data line to a voltage obtained by subtracting an absolute value of a threshold voltage of the driving transistor from a voltage of the first power supply by electrically coupling the driving transistor in a diode-connected configuration while supplying the reference voltage to the first data line; and varying a voltage of the gate electrode of the driving transistor by providing data signals to the first data line.

According to the above described embodiments of the present invention, an organic light emitting display device can display an image having a desired luminance irrespective of the voltage drop of a first power supply and the threshold voltage of a driving transistor. According to the embodiments of the present invention, it is possible to compensate for the voltage drop of the first power supply and the threshold voltage of the driving transistor by using a relatively simple structure in which four transistors and one capacitor are included in a pixel, thereby improving reliability. Further, the embodiments of the present invention may be applied to an organic light emitting display device using a demultiplexer.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
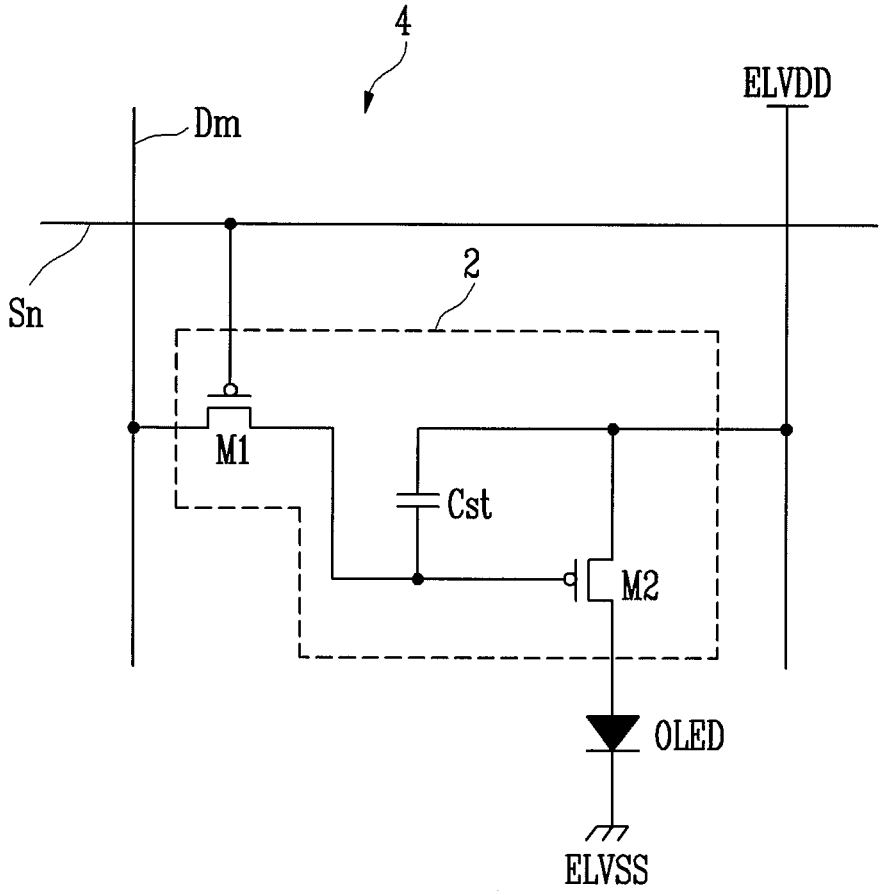
FIG. 1 (Related Art)
FIG. 1 is a circuit diagram showing a pixel of an organic light emitting display device according to the related art.

Hereinafter, certain exemplary embodiments according to the present invention will be described with reference to the accompanying drawings. Here, when a first element is described as being connected or coupled to a second element, the first element may be directly coupled to the second element or indirectly coupled to the second element via a third element. Further, some of the elements that are not essential to a complete understanding of the invention are omitted for clarity. Also, like reference numerals refer to like elements throughout.

Hereinafter, exemplary embodiments of the present invention will be described in detail with reference to FIGS. 2 to 8E.

Figure 2:
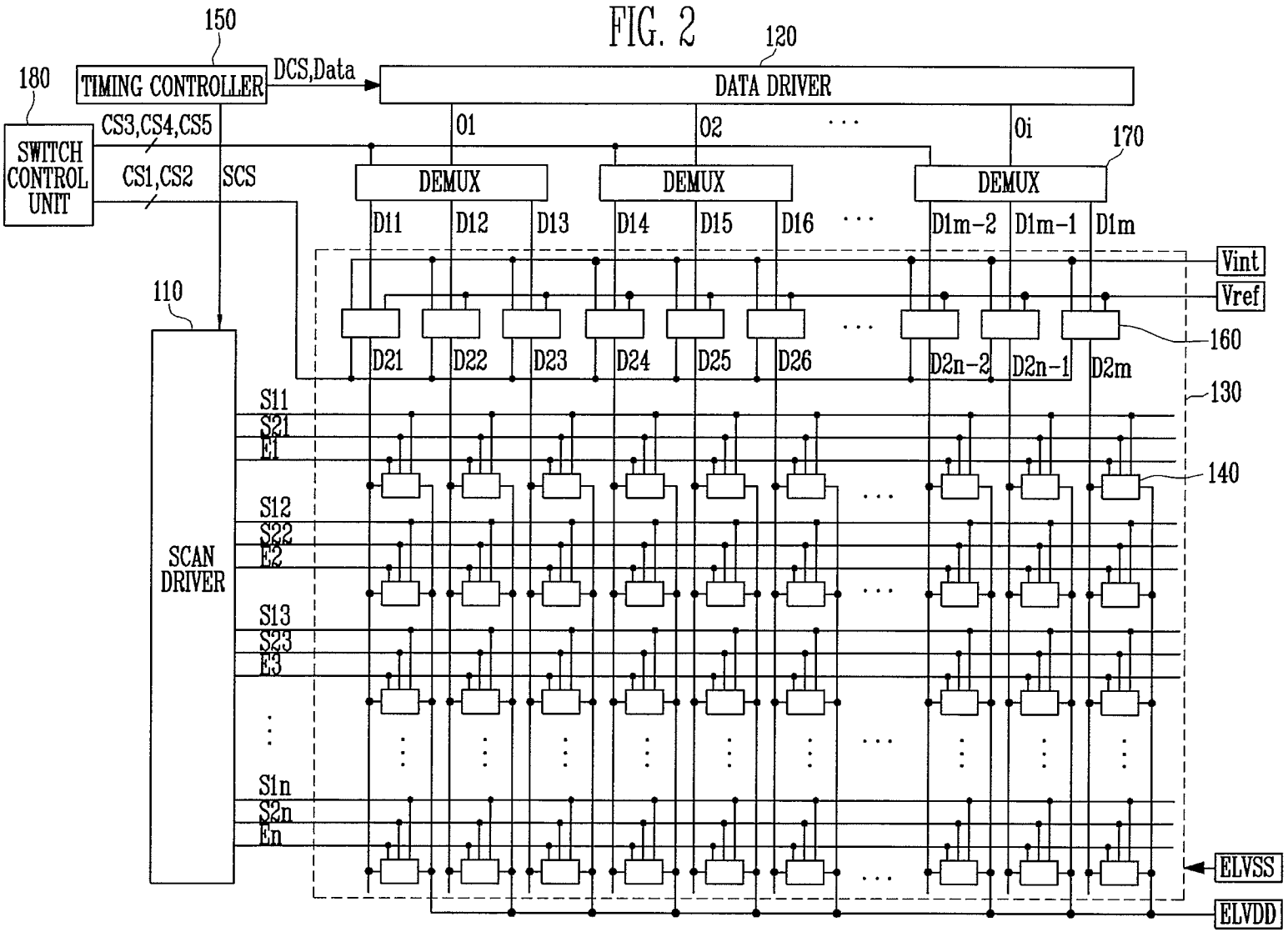
FIG. 2 is a block diagram showing an organic light emitting display device according to an embodiment of the present invention.

FIG. 2 is a block diagram showing an organic light emitting display device according to an embodiment of the present invention. In FIG. 2, a demultiplexer (hereinafter, referred to as "DEMUX") 170 is connected to j (j is a natural number of 2 or more) data lines, but it is assumed that j is 3 for the convenience of description.

Referring to FIG. 2, the organic light emitting display device according to one embodiment of the present invention includes a display unit 130 that includes pixels 140 positioned at crossing regions of first scan lines S11 to S1*n*, second scan lines S21 to S2*n*, and second data lines D21 to D2*m*, common circuit units 160, which are connected between first data lines D11 to D1*m* and the second data lines D21 to D2*m*, connected to the DEMUXs 170, a scan driver 110 for driving the first scan lines S11 to S1*n*, the second scan lines S21 to S2*n*, and emission control lines E1 to En, a data driver 120 for providing j data signals to each of output lines O1 to Oi, respectively, during a horizontal period, and a timing controller 150 for controlling the scan driver 110 and the data driver 120.

In addition, according to one embodiment of the present invention, each of the DEMUXs 170 is connected to a corresponding one of the output lines O1 to Oi. Each of the output lines O1 to Oi provides j data signals to a connected one of the DEMUXs 170 during a horizontal period. The organic light emitting display device according to one embodiment of the present invention includes a switch control unit 180 for controlling the common circuit units 160.

The scan driver 110 receives a scan driving control signal SCS from the timing controller 150. The scan driver 110 that receives the scan driving control signal SCS generates and sequentially provides first scan signals to the first scan lines S11 to S1*n* and generates and sequentially provides second scan signals to the second scan lines S21 to S2*n*. In addition, the scan driver 110 generates and sequentially provides emission control signals to the emission control lines E1 to En.

Here, the first scan signals and the second scan signals are set to a voltage (e.g., low voltage) at which transistors included in the pixel 140 may be turned on, and the emission control signals are set to a voltage (e.g., high voltage) at which the transistors included in the pixel 140 may be turned off. In addition, a second scan signal provided to a k-th (k is a natural number) second scan line S2*k* is provided earlier than a first scan signal provided to a k-th first scan line S1*k* and stops to be provided after the first scan signal stops to be provided. Further, the emission control signal provided to the emission control line (E1 to En) is provided to be overlapped with two second scan signals. For example, the emission control signal provided to the k-th emission control line Ek overlaps with the second scan signals provided to a k-th second scan line S2*k* and a (k+1)-th second scan line S2*k*+1.

The data driver 120 receives a data driving control signal DCS from the timing controller 150. The data driver 120 that receives the data driving control signal DCS provides j data signals to each of the output lines O1 to Oi in every horizontal period. Here, the data driver 120 provides the data signals to the output lines O1 to Oi during a period when the first scan signal is not provided and the second scan signal is provided.

The timing controller 150 generates the data driving control signal DCS and the scan driving control signal SCS to correspond to externally provided synchronization signals. The data driving control signal DCS generated by the timing controller 150 is provided to the data driver 120, and the scan driving control signal SCS is provided to the scan driver 110. In addition, the timing controller 150 provides externally provided data Data to the data driver 120.

Each of the DEMUXs 170 is connected between a corresponding one of the output lines O1 to Oi and j first data lines. Each of the DEMUXs 170 distributes j data signals supplied from each of the output lines O1 to Oi to correspond to control signals CS1, CS2, and CS3 provided from the switch control unit 180 to j first data lines D11 to D1*m*.

The common circuit units 160 are formed between the first data lines D11 to D1*m* and the second data lines D21 to D2*m*, respectively. The common circuit units 160 receive an initial voltage Vint and a reference voltage Vref supplied from the outside. Each of the common circuit units 160 that receives the initial voltage Vint and the reference voltage Vref controls voltage of a first data line to which the common circuit unit 160 is connected in accordance with the control of the switch control unit 180.

The switch control unit 180 controls turn-on and turn-off of transistors included in the DEMUXs 170 and the common circuit units 160 while providing control signals CS3 to CS5 to the DEMUXs 170 and control signals CS1 to CS2 to the common circuit units 160. Here, the switch control unit 180 provides the third control signal CS3 to the fifth control signal CS5 in order to control three transistors included in the DEMUX 170 and provides the first control signal CS1 and the second control signal CS2 in order to control two transistors included in the common circuit unit 160.

In FIG. 2, the switch control unit 180 is additionally shown for the convenience of description according to one embodiment, but the present invention is not limited thereto. As one example, the switch control unit 180 may be included in the timing controller 150. In this case, the timing controller 150 generates the first control signal CS1 to the fifth control signal CS5 to control driving of the DEMUXs 170 and the common circuit units 160.

Each of the pixels 140 receives a first power supply ELVDD and a second power supply ELVSS from the outside. The pixels 140 that receive the first power supply ELVDD and the second power supply ELVSS generate light having a luminance (e.g., a predetermined luminance) while controlling the amount of current that flows to the second power supply ELVSS from the first power supply ELVDD to correspond to the data signals.

Figure 3:
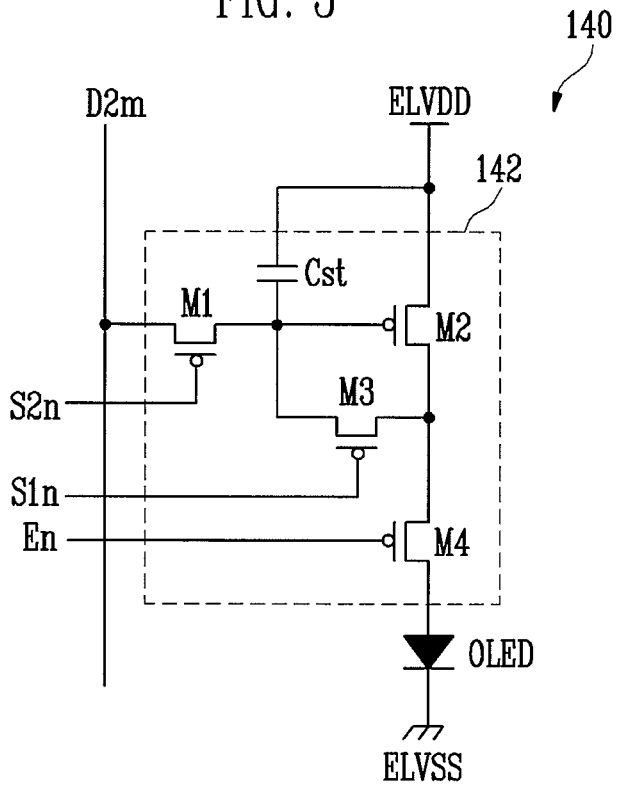
FIG. 3 is a circuit diagram showing an embodiment of a pixel shown in FIG. 2.

FIG. 3 is a circuit diagram showing an embodiment of a pixel shown in FIG. 2. In FIG. 3, a pixel 140 connected to a 2*m*-th data line D2*m* and a 1*n*-th scan line S1*n* is shown.

Referring to FIG. 3, the pixel 140 according to one embodiment of the present invention includes an organic light emitting diode OLED and a pixel circuit 142 for supplying current to the OLED.

An anode electrode of the OLED is connected to the pixel circuit 142 and a cathode electrode of the OLED is connected to the second power supply ELVSS. The OLED generates light having a luminance (e.g., a predetermined luminance) to correspond to the amount of current supplied from the pixel circuit 142.

The pixel circuit 142 receives a voltage (e.g., a predetermined voltage) corresponding to the data signal and supplies a current corresponding to the received voltage to the OLED. Here, the pixel circuit 142 includes first to fourth transistors M1 to M4 and a storage capacitor Cst.

A first electrode of the first transistor M1 is connected to the common circuit unit 160 through the second data line D2*m* and a second electrode of the first transistor M1 is connected to a gate electrode of the second transistor M2. In addition, a gate electrode of the first transistor M1 is connected to the second scan line S2*n*. The first transistor M1 is turned on when the scan signal is provided to the second scan line S2*n*.

A first electrode of the second transistor M2 is connected to the first power supply ELVDD, and a second electrode of the second transistor M2 is connected to a first electrode of the fourth transistor M4. In addition, the gate electrode of the second transistor M2 is connected to the second electrode of the first transistor M1. The second transistor M2 supplies a current corresponding to a voltage applied to its own gate electrode to the OLED through the fourth transistor M4.

A first electrode of the third transistor M3 is connected to the second electrode of the second transistor M2, and the second electrode of the third transistor M3 is connected to the gate electrode of the second transistor M2. In addition, a gate electrode of the third transistor M3 is connected to the first scan line S1*n*. The third transistor M3 is turned on when the scan signal is provided to the first scan line S1*n*. In this case, the third transistor M3 remains turned off after the first transistor M1 is turned on and turned off before the first transistor M1 is turned off. Here, when the third transistor M3 is turned on, the second transistor M2 is connected in a diode-connected configuration.

A first electrode of the fourth transistor M4 is connected to the second electrode of the second transistor M2, and the second electrode of the fourth transistor M4 is connected to the anode electrode of the OLED. In addition, a gate electrode of the fourth transistor M4 is connected to the emission control line En. The fourth transistor M4 is turned off when the emission control signal is provided and turned on when the emission control signal is not provided.

The storage capacitor Cst is connected between the gate electrode and the first electrode of the second transistor M2. The storage capacitor Cst is charged with a voltage (e.g., a predetermined voltage) to correspond to the voltage applied to the gate electrode of the second transistor M2.

Figure 4:
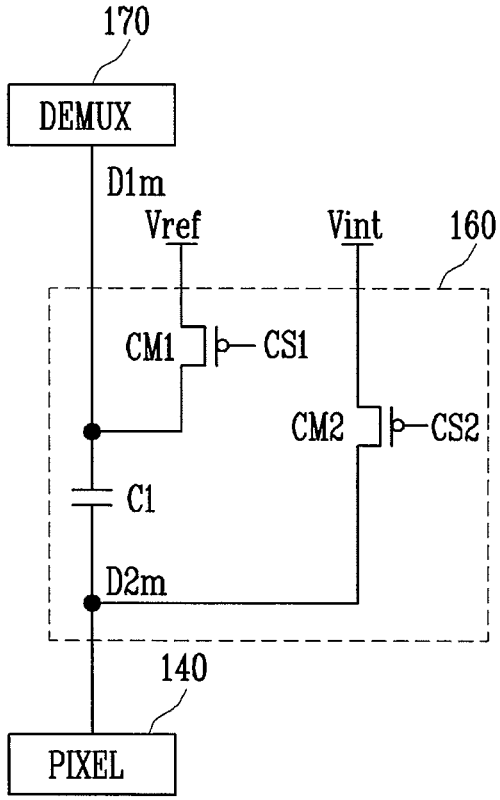
FIG. 4 is a circuit diagram showing an embodiment of a common circuit unit shown in FIG. 2.

FIG. 4 is a circuit diagram showing an embodiment of a common circuit unit 160 shown in FIG. 2. In FIG. 4, the common circuit unit 160 is connected to a 1*m*-th data line D1*m*. In addition, the common circuit unit 160 is connected to a plurality of pixels 140 in a unit of a vertical line (e.g., a column of pixels), but only one pixel 140 is shown in FIG. 4.

Referring to FIG. 4, the common circuit unit 160 includes a first capacitor C1 having a first terminal connected to the first data line D1*m* and a second terminal connected to the second data line D2*m*, a first common transistor CM1 connected between the reference voltage Vref and the first terminal of the first capacitor C1, and a second common transistor CM2 connected between the initial voltage Vint and the second terminal of the first capacitor C1.

The first common transistor CM1 is connected between the reference voltage Vref and the first terminal of the first capacitor C1 and is turned on when the first control signal CS1 is provided. When the first common transistor CM1 is turned on, the voltage of the reference voltage Vref is supplied to the first terminal of the first capacitor C1.

The second common transistor CM2 is connected between the initial voltage Vint and the second terminal of the first capacitor C1 and is turned on when the second control signal CS2 is provided. When the second common transistor CM2 is turned on, the voltage of the initial voltage Vint is supplied to the second terminal of the second capacitor C2.

The first capacitor C1 is formed between the first data line D1*m* and the second data line D2*m*. The first capacitor C1 varies the voltage (i.e., the voltage of the second data line D2*m*) supplied to the pixel 140 to correspond to the data signal provided to the DEMUX 170.

Figure 5:
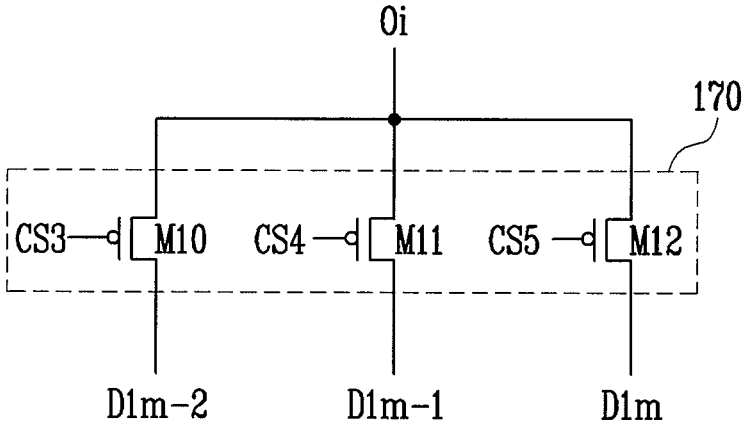
FIG. 5 is a circuit diagram showing a demultiplexer shown in FIG. 2.

FIG. 5 is a circuit diagram showing an embodiment of a DEMUX 170 shown in FIG. 2. In FIG. 5, a DEMUX 170 is connected to the i-th output line Oi.

Referring to FIG. 5, the DEMUX 170 includes a 10-th transistor M10, an 11-th transistor M11, and a 12-th transistor M12.

The 10-th transistor M10 is connected between the output line Oi and a (1*m*-2)-th data line D1*m*-2. The 10-th transistor M10 is turned on when the third control signal CS3 is supplied to provide the data signal provided from the output line Oi to the (1*m*-2)-th data line D1*m*-2.

The 11-th transistor M11 is connected between the output line Oi and a (1m-1)-th data line D1m-1. The 11-th transistor M11 is turned on when the fourth control signal CS4 is supplied to provide the data signal provided from the output line Oi to the (1m-1)-th data line D1m-1.

The 12-th transistor M12 is connected between the output line Oi and the 1m-th data line D1m. The 12-th transistor M12 is turned on when the fifth control signal CS5 is supplied to provide the data signal provided from the output line Oi to the 1m-th data line D1m.

Here, the third control signal CS3 to the fifth control signal CS5 are sequentially supplied, and, as a result, the data signals are supplied to the (1m-2)-th data line D1m-2, the (1m-1)-th data line D1m-1, and the first data line D1m while the 10-th transistor M10 to the 12-th transistor M12 are sequentially turned on.

Figure 6:
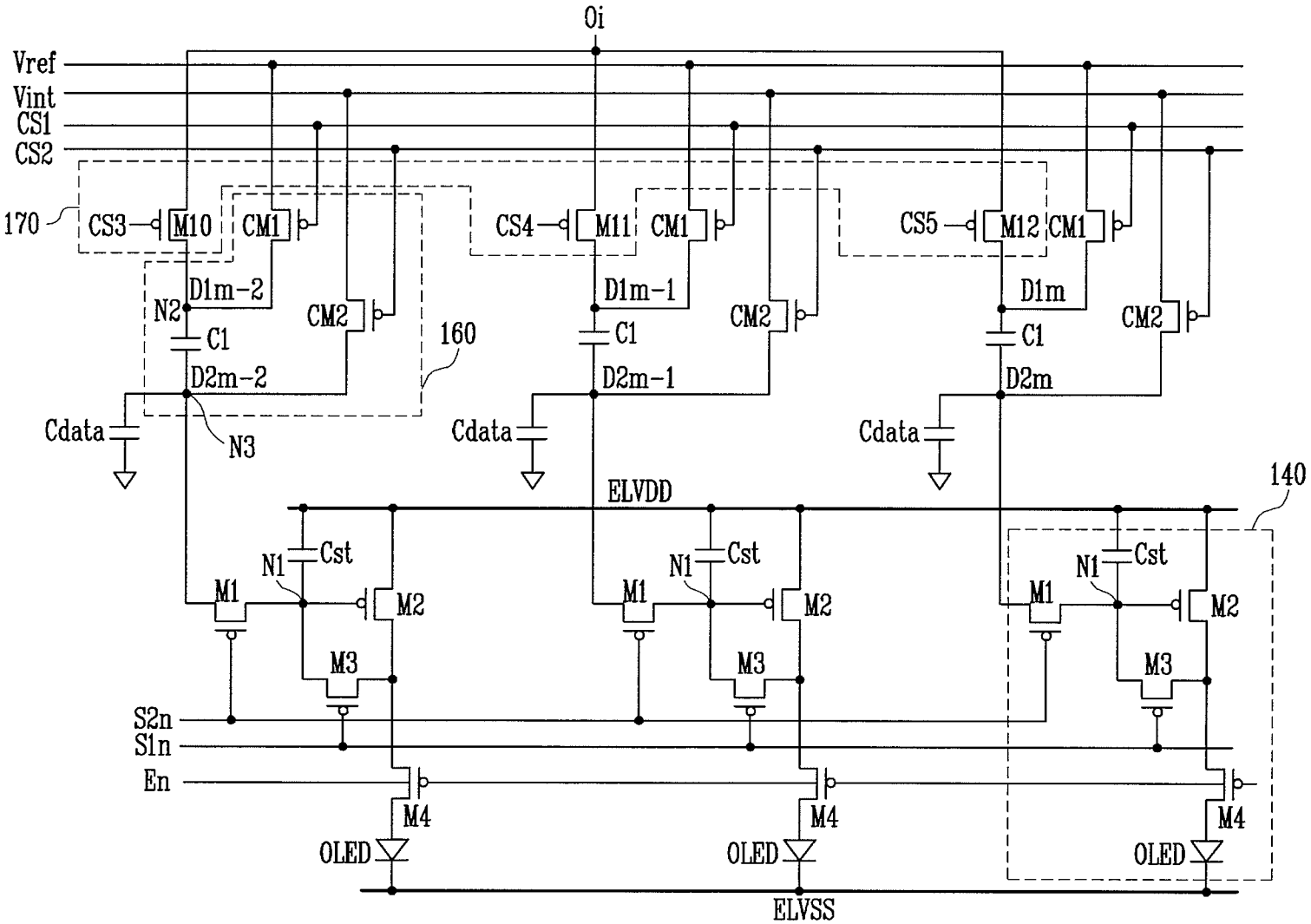
FIG. 6 is a circuit diagram showing a connection structure of a demultiplexer, a common circuit unit, and pixels.

FIG. 6 is a circuit diagram showing a connection structure of a demultiplexer, a common circuit unit, and pixels. In FIG. 6, the DEMUX 170 connected to the i-th output line Oi, the common circuit units 160, and the pixels 140 are shown according to one embodiment of the present invention.

Referring to FIG. 6, the output line Oi is connected to the DEMUX 170, and the DEMUX 170 includes the 10-th transistor M10, the 11-th transistor M11, and the 12-th transistor M12 that are connected to the first data lines D1m-2, D1m-1, and D1m, respectively.

The common circuit units 160 are positioned between the first data lines D1m-2, D1m-1, and D1m and the second data lines D2m-2, D2m-1, and D2m, respectively. The common circuit units 160 control voltages of the second data lines D2m-2, D2m-1, and D2m to correspond to the initial voltage Vint, the reference voltage Vref, and the data signals.

In addition, in FIG. 6, a data capacitor Cdata represents an equivalent parasitic capacitor. Here, since a first terminal of the first capacitor C1 is positioned adjacent to the DEMUX 170, the parasitic capacitor formed by the first data line does not substantially influence driving. However, since the pixel 140 connected to a second terminal of the first capacitor C1 are separated from each other in a vertical direction by a distance (e.g., a predetermined distance), a parasitic capacitor of the second data line influences driving. As a panel becomes larger, the influence of the parasitic capacitor of the second data line becomes larger. Therefore, in one embodiment of the present invention, the parasitic capacitor of the second data line that influences driving is shown as the data capacitor Cdata in FIG. 6.

Figure 7:
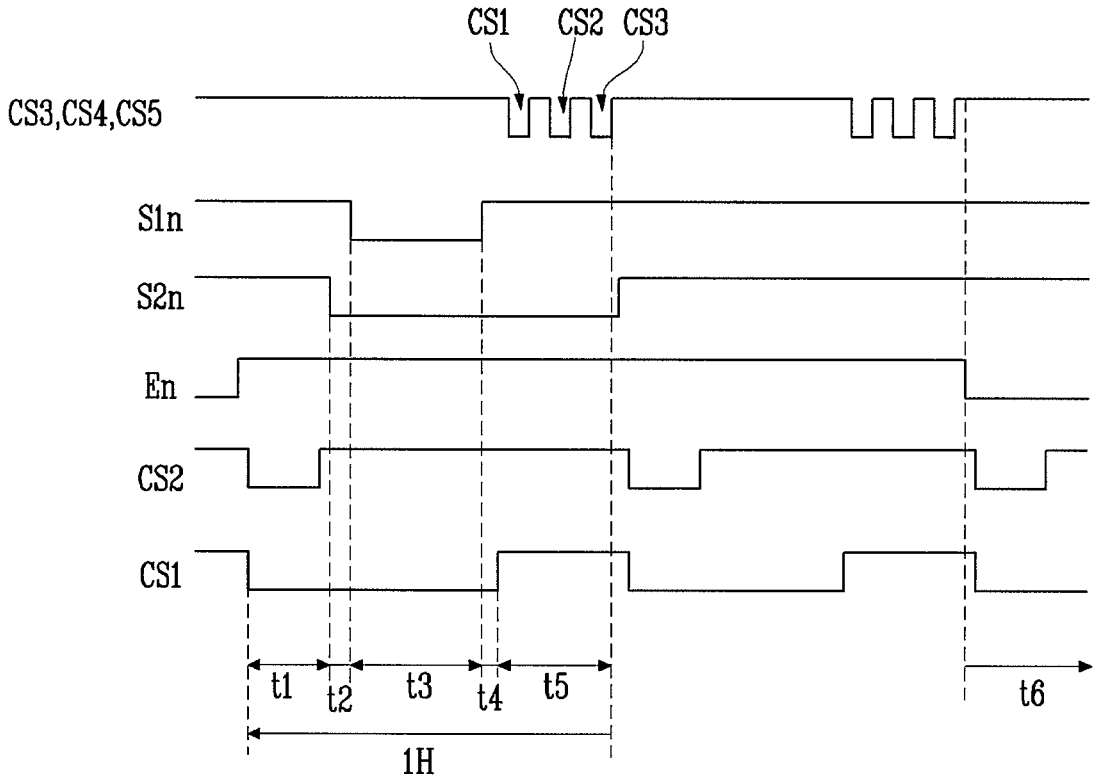
FIG. 7 is a waveform diagram for showing driving methods of a demultiplexer, a common circuit unit, and pixels shown in FIG. 6.

FIG. 7 is a waveform diagram for showing driving methods of a demultiplexer, a common circuit unit, and pixels shown in FIG. 6.

Referring to FIG. 7, a first horizontal period 1H is divided into a first period t1 to a fifth period t5.

First, during the first period t1, the first control signal CS1 and the second control signal CS2 are provided. Here, the first control signal CS1 is provided during the first period t1 to the fourth period t4, and the second control signal CS2 is provided during the first period t1.

Figure 8A:
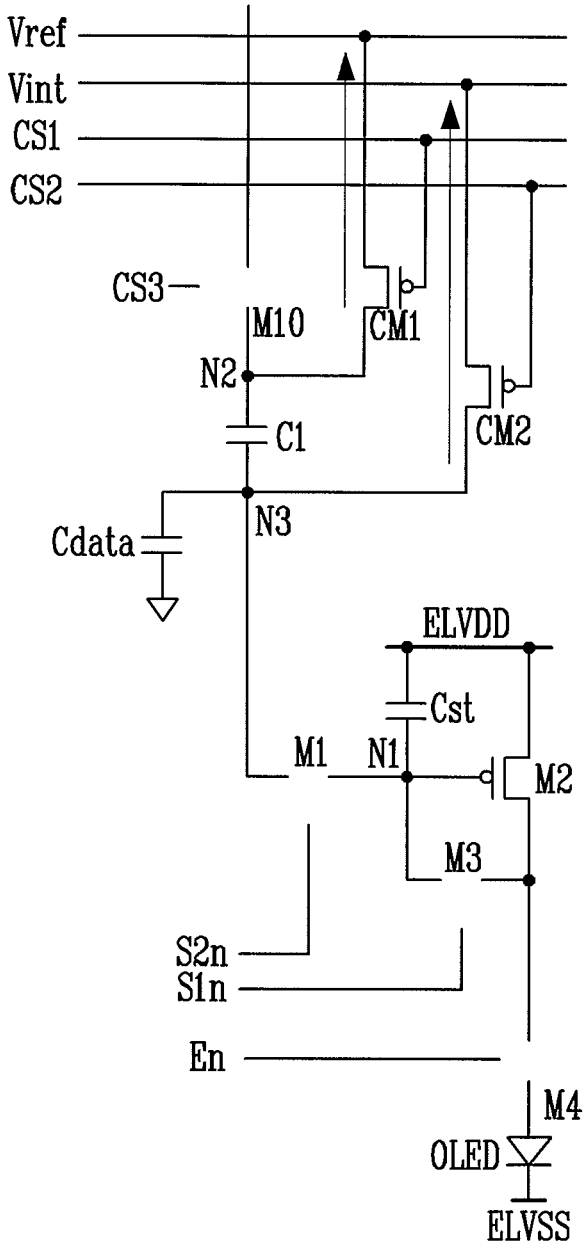
FIGS. 8A, 8B, 8C, 8D, and 8E are circuit diagrams for showing a driving process according to the waveform diagram of FIG. 7.

When the first control signal CS1 is provided, the first common transistor CM1 is turned on as shown in FIG. 8A. In FIGS. 8A to 8E, when a transistor is turned off, only its reference numeral is shown in the drawing without its circuit symbol. However, it should be understood that the transistor is not physically removed from the circuit shown in FIGS. 8A to 8E. When the first common transistor CM1 is turned on, the voltage of the reference voltage Vref is supplied to a second node N2 (i.e., the first terminal of the first capacitor C1). Here, the voltage of the reference voltage Vref is set to a voltage lower than the voltage of a black data signal Vdata(black). The detailed description thereof will be described below.

When the second control signal CS2 is provided, the second common transistor CM2 is turned on. When the second common transistor CM2 is turned on, the voltage of the initial voltage Vint is supplied to a third node N3 (i.e., the second terminal of the first capacitor C1). Here, the voltage of the initial voltage Vint is set to a voltage sufficiently lower than a voltage obtained by subtracting an absolute value of the threshold voltage of the second transistor M2 from the voltage of the first power supply ELVDD. Here, when the initial voltage Vint is electrically connected to the first node N3 and the first node N1, the voltage of the first node N1 is set to the voltage lower than the voltage obtained by subtracting the absolute value of the threshold voltage of the second transistor M2 from the voltage of the first power supply ELVDD.

Here, since the first transistor M1 maintains a turn-off state during the first period t1, the first node N1 (i.e., the gate electrode of the second transistor M2) maintains the voltage charged during a previous frame period.

Figure 8B:
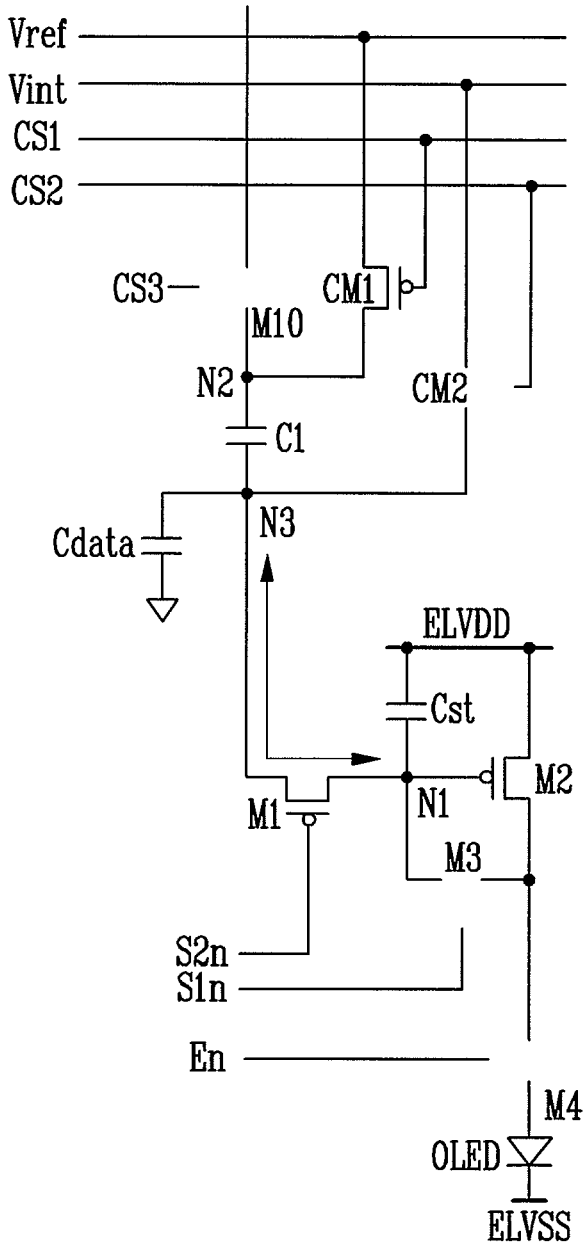

The second scan signal is provided to the second scan line S2n during the second period t2. When the scan signal is provided to the second scan line S2n, the first transistor M1 is turned on as shown in FIG. 8B. When the first transistor M1 is turned on, the first node N1 and the third node N3 are electrically connected to each other. Here, the second scan signal is provided during the second period t2 to the fifth period t5.

Figure 8C:
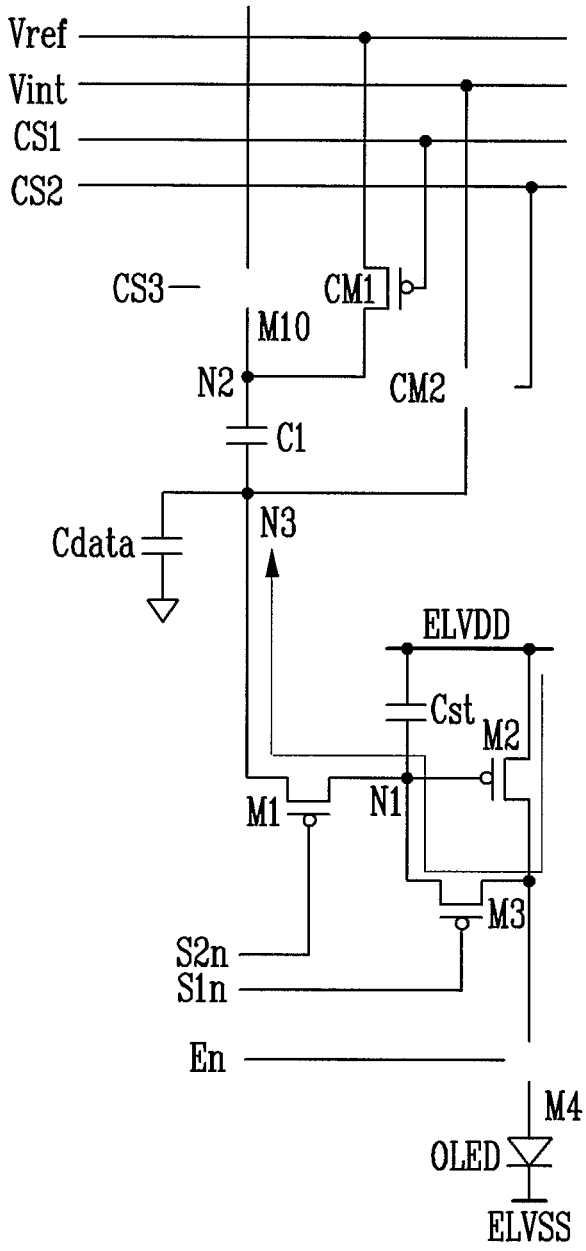
Figure 8D:
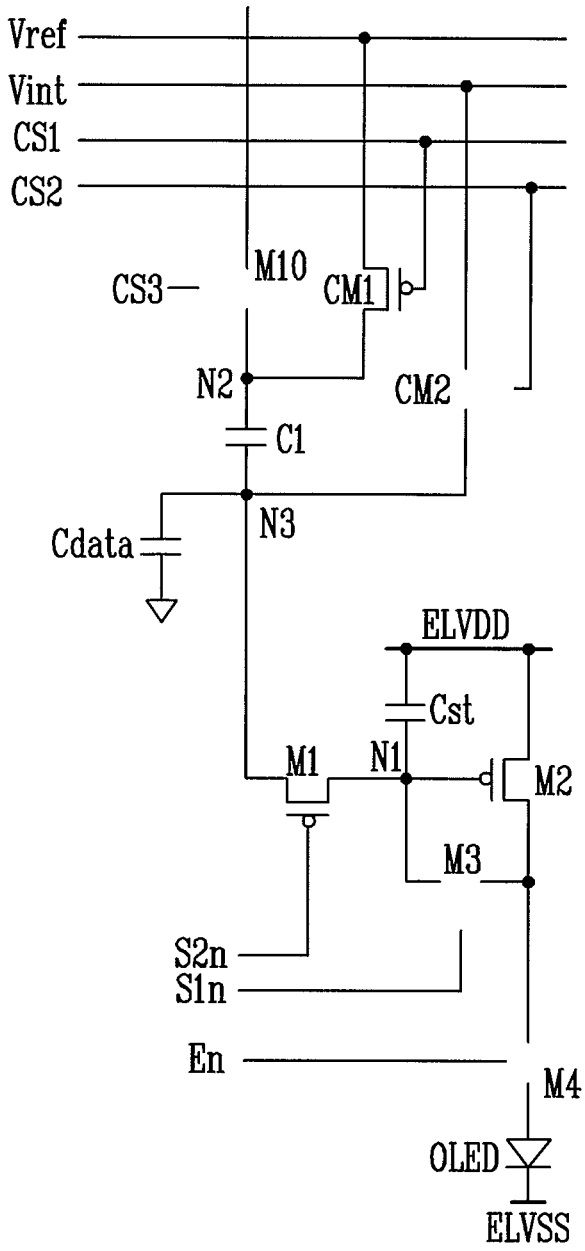

The first scan signal is provided to the first scan line S1n during the third period t3. When the first scan signal is provided to the first scan line S1n, the third transistor M3 is turned on as shown in FIG. 8C. When the third transistor M3 is turned on, the second transistor M2 is connected in the diode-connected configuration. In this case, the voltages of the first node N1 and the third node N3 are set to the voltage obtained by subtracting the absolute value of the threshold voltage of the second transistor M2 from the voltage of the first power supply ELVDD as shown in Equation 1.

$$V_{N1}=V_{N3}=ELVDD-|Vth(M2)| \quad \text{Equation 1}$$

Here, in one embodiment of the present invention, after the second scan signal is provided to the second scan line S2n, the first scan signal is provided to the first scan line S1n. That is, in the embodiment of the present invention, it is possible to secure the reliability of an operation by providing the first scan signal after initializing the voltage of the first node N1 by firstly providing the second scan signal.

During the fourth period t4, the first scan signal stops to be provided. When the first scan signal stops to be provided, the third transistor M3 is turned off.

Figure 8E:
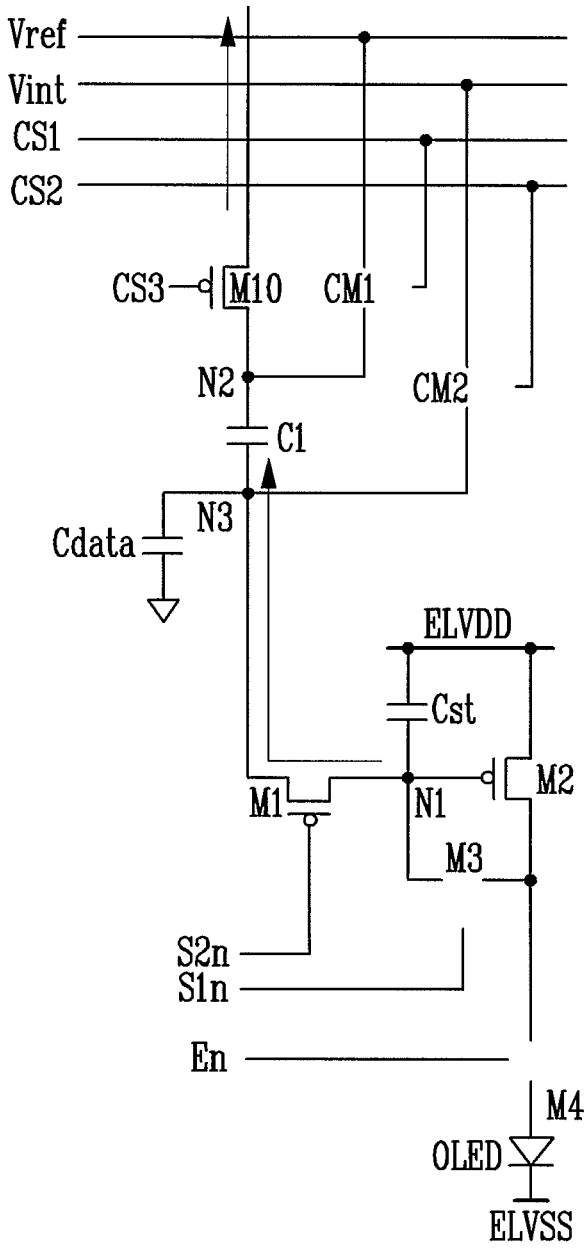

During the fifth period t5, the third control signal CS3, the fourth control signal CS4, and the fifth control signal CS5 are sequentially provided while the first control signal CS1 is not provided. When the first control signal CS1 is not provided, the first common transistor CM1 is turned off as shown in FIG. 8E. Here, since the first control signal CS1 stops to be provided after the first scan signal stops to be provided, the second node N2 maintains the voltage of the reference voltage Vref irrespective of the turn-off of the third transistor M3.

When the third control signal CS3 is provided, the 10-th transistor M10 is turned on. When the 10-th transistor M10 is turned on, the data signal provided to the output line Oi is provided to the second node N2. In this case, the voltage of the second node N2 is changed to the voltage of the data signal from the voltage of the reference voltage Vref.

When the voltage of the second node N2 is changed to the voltage of the data signal from the voltage of the reference voltage Vref, the voltage of the first node N1 varies as shown in Equation 2 to correspond to the variation of the voltage of the second node N2 from a voltage of ELVDD−|Vth(M2)|.

$$V_{N1}=ELVDD-|Vth(M2)|+\{(C1+Cdata+Cst)/C1\}\times(Vdata-Vref) \quad \text{Equation 2}$$

In Equation 2, Vdata represents the voltage of the data signal.

In Equation 2, the first power supply ELVDD, the threshold voltage of the second transistor M2, the first capacitor C1, the data capacitor Cdata, and the storage capacitor Cst have respective determined values in design. In addition, the voltage of the reference voltage Vref is set to a value corresponding to the capacitances of the data capacitor Cdata and the first capacitor C1. Here, the voltage value of the reference voltage Vref is experimentally set so as to charge the pixel 140 with the desired voltage irrespective of the capacitances of the data capacitor Cdata and the first capacitor C1.

The voltage value of the voltage Vdata of the data signal varies depending on a gray-level to be expressed. That is, in Equation 2, only the voltage Vdata of the data signal varies depending on the gray-level, and, as a result, the voltage of the first node N1 is determined by the voltage Vdata of the data signal.

Thereafter, the 11-th transistor M11 and the 12-th transistor M12 are sequentially turned on to correspond to the fourth control signal CS4 and the fifth control signal CS5, respectively. At this time, the voltage of the first node N1 of the pixel 140 connected to each of the 11-th transistor M11 and the 12-th transistor M12 is set as shown in Equation 2.

After the fifth period t5, the second scan signal stops to be provided to the second scan line S2*n*, such that the first transistor M1 is turned off. In this case, the storage capacitor Cst is charged with the voltage applied to the first node N1 and maintains the charged voltage during the fifth period t5.

Thereafter, the emission control signal stops to be provided to the emission control line En during a sixth period t6. When the emission control signal stops to be provided to the emission control line En, the fourth transistor M4 is turned on. When the fourth transistor M4 is turned on, the second transistor M2 and the anode electrode of the OLED are electrically connected to each other. In this case, the second transistor M2 supplies a current corresponding to the voltage applied to the first node N1 to the OLED to emit light corresponding to a gray-level.

Here, in one embodiment of the present invention, the voltage of the reference voltage Vref is set to a voltage lower than the voltage of the black data signal Vdata(black). When the voltage of the reference voltage Vref is set to the voltage lower than the voltage of the black data signal Vdata(black), the voltage of the first node N1 is set to a voltage higher than the voltage of ELVDD−|Vth(M2)| to express a full black color at the time of expressing a black gray-level.

In addition, as shown in Equation 2, when the voltage of the first node N1 is set, the current supplied to the OLED is determined irrespective of the voltage drop of the first power supply ELVDD and the threshold voltage of the second transistor M2. In other words, ELVDD−|Vth(M2)| is removed from an equation for determining a current flowing on the OLED, and, as a result, it is possible to display an image having a desired luminance irrespective of the voltage drop of the first power supply ELVDD and the threshold voltage of the second transistor M2.

Further, in one embodiment of the present invention, a relatively simple structure in which each of the pixels 140 includes four transistors M1 to M4 and only one capacitor Cst is formed, thereby improving reliability and reducing manufacturing cost.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device driven during a horizontal period comprising first, second, third, fourth, and fifth periods, a scan driver for driving one or more scan lines and emission control lines grouped by horizontal lines of the organic light emitting display device;

a data driver for sequentially providing j data signals to each of a plurality of output lines of the data driver in each horizontal period;

a demultiplexer for transmitting the j data signals to j first data lines, the demultiplexer being coupled to the output lines;

a plurality of pixels at crossing regions of the scan lines and second data lines extending in a direction crossing the scan lines; and a common circuit unit for controlling voltages of the second data lines coupled to the pixels by using a reference voltage, an initial voltage and the data signals, the common circuit unit being coupled between the j first data lines and the second data lines, and being configured to selectively apply the reference voltage to the j first data lines and the initial voltage to the second data lines.

2. The organic light emitting display device of claim 1, wherein the reference voltage is a voltage that is lower than a voltage of a black data signal for expressing a black gray-level.

3. The organic light emitting display device of claim 1, further comprising a switch control unit for controlling the demultiplexer and the common circuit unit.

4. The organic light emitting display device of claim 3, wherein the demultiplexer comprises j transistors coupled between one of the output lines and the j first data lines, and the j transistors being configured to be sequentially turned on in response to j control signals provided from the switch control unit.

5. The organic light emitting display device of claim 4, wherein the j control signals are sequentially provided during the fifth period of the horizontal period.

6. The organic light emitting display device of claim 3, wherein the common circuit unit comprises:

a first capacitor coupled between one of the first data lines and one of the second data lines;

a first common transistor coupled between said one of the first data lines and a voltage source for providing the reference voltage and configured to be turned on in response to a first control signal from the switch control unit; and a second common transistor coupled between said one of the second data lines and a voltage source for providing the initial voltage and configured to be turned on in response to a second control signal from the switch control unit.

7. The organic light emitting display device of claim 6, wherein the switch control unit is configured to concurrently provide the first control signal and the second control signal in each horizontal period, the second control signal being longer than the first control signal.

8. The organic light emitting display device of claim 7, wherein the switch control unit is configured to provide the second control signal during the first period of the horizontal period and provide the first control signal during the first to fourth periods of the horizontal period.

9. The organic light emitting display device of claim 7, wherein the switch control unit is configured to provide j control signals for controlling the demultiplexer, the j control signals being not overlapped with the first control signal and the second control signal in each horizontal period.

10. The organic light emitting display device of claim 1, wherein each of the horizontal lines comprises a first scan line of the scan lines, a second scan line of the scan lines, and one of the emission control lines.

11. The organic light emitting display device of claim 10, wherein the scan driver is configured to sequentially provide first scan signals to the first scan lines, sequentially provide second scan signals to the second scan lines, and sequentially provide emission control signals to the emission control lines.

12. The organic light emitting display device of claim 11, wherein each of the pixels comprises:

an organic light emitting diode having a cathode electrode coupled to a second power supply;

a second transistor having a first electrode coupled to a first power supply for controlling an amount of current supplied to the organic light emitting diode;

a first transistor coupled between a gate electrode of the second transistor and one of the second data lines and configured to be turned on when the second scan signals are provided to said one of the second scan lines;

a third transistor coupled between the gate electrode of the second transistor and a second electrode of the second transistor and configured to be turned on when the second scan signals are provided to said one of the second scan lines; and a fourth transistor coupled between the second transistor and an anode electrode of the organic light emitting diode and configured to be turned off when the emission control signals are provided to said one of the emission control lines.

13. The organic light emitting display device of claim 12, wherein the initial voltage is a voltage that is lower than a voltage obtained by subtracting an absolute value of a threshold voltage of the second transistor from a voltage of the first power supply.

14. The organic light emitting display device of claim 11, wherein the scan driver is configured to provide the second scan signals during the second to fifth periods of the horizontal period and provide the first scan signals during the third period of the horizontal period.

15. The organic light emitting display device of claim 11, wherein each of the emission control signals overlaps with at least two of the second scan signals.

16. The organic light emitting display device of claim 1, wherein the data driver is configured to sequentially provide the j data signals during the fifth period of the horizontal period.

17. A driving method of an organic light emitting display device that comprises a pixel comprising a first capacitor coupled between a first data line for receiving a data signal and a second data line coupled to the pixel and a driving transistor for controlling an amount of current flowing to a second power supply from a first power supply through an organic light emitting diode, the method comprising:

supplying a reference voltage to the first data line and supplying an initial voltage to the second data line;

electrically coupling the second data line to a gate electrode of the driving transistor while supplying the reference voltage to the first data line;

increasing the voltage of the second data line to a voltage obtained by subtracting an absolute value of a threshold voltage of the driving transistor from a voltage of the first power supply by electrically coupling the driving transistor in a diode-connected configuration while supplying the reference voltage to the first data line; and varying a voltage of the gate electrode of the driving transistor by providing data signals to the first data line.

18. The driving method of an organic light emitting display device of claim 17, wherein the reference voltage is lower than a voltage of a black data signal for expressing a black gray-level.

19. The driving method of an organic light emitting display device of claim 17, wherein the initial voltage is lower than the voltage obtained by subtracting the absolute value of the threshold voltage of the driving transistor from the voltage of the first power supply.

20. The driving method of an organic light emitting display device of claim 17, wherein the driving transistor is in a diode-connected configuration during said varying the voltage of the gate electrode of the driving transistor.

* * * * *